US005556688A

United States Patent [19]

Cox

[11] Patent Number: 5,556,688

[45] Date of Patent: Sep. 17, 1996

[54] WALL PATCHING DEVICE AND METHOD

[76] Inventor: James A. Cox, 116 Rue du Bois, Cherry Hill, N.J. 08003

[21] Appl. No.: 394,706

[22] Filed: Feb. 27, 1995

[51] Int. Cl.[6] ..... B32B 3/04; E04G 23/02

[52] U.S. Cl. ..... 428/122; 52/514; 428/63; 428/192; 428/245

[58] Field of Search ..... 428/122, 63, 192, 428/245; 52/514

[56] References Cited

U.S. PATENT DOCUMENTS

| | | | |
|---|---|---|---|
| D. 324,170 | 2/1992 | Owens et al. | D8/402 |
| 2,598,194 | 5/1952 | Shippey | 52/514 |
| 3,289,374 | 12/1966 | Metz | 52/514 |
| 3,295,285 | 1/1967 | Metz | 428/63 |
| 3,717,970 | 2/1973 | Rosenblum | 52/514 |
| 3,995,404 | 12/1976 | Thaw et al. | 52/514 |
| 4,152,877 | 5/1979 | Green | 52/514 |
| 4,285,183 | 8/1981 | Condit | 52/514 |
| 4,668,548 | 5/1987 | Lankard | 428/63 |
| 4,697,396 | 10/1987 | Knight | 52/514 |
| 5,269,861 | 12/1993 | Gilbreath | 428/63 |
| 5,299,404 | 4/1994 | Jabro | 52/514 |

*Primary Examiner*—Nasser Ahmad
*Attorney, Agent, or Firm*—Miller & Christenbury

[57] ABSTRACT

An article for repairing an opening in a wall surface and including at least one bracket forming a cage when installed in the opening. The bracket has a substantially "U"-shaped body with legs terminating at outwardly extending flanges. Each flange is adapted for insertion into the edge of the opening when the bracket is installed. The article also includes a support sized and shaped to substantially fill the cage. The support has at least one element to which patch material bonds when the article is placed in the opening and the patch material is introduced into the opening.

3 Claims, 9 Drawing Sheets

WALL PATCHING DEVICE AND METHOD

BACKGROUND OF THE INVENTION

This invention relates to a device and method for patching damaged wall surfaces. Specifically, this invention provides a device and method for containing and supporting patch material and for repairing regularly or irregularly shaped holes.

FIELD OF THE INVENTION

There is a constant demand for devices and methods for repairing damaged wall materials, including gypsum board, wallboard, sheetrock, drywall, plaster or other wall materials commonly used in residential, commercial and industrial structures. As just one example, wall materials are often damaged by doorknobs and must be restored.

A problem arises when a hole in a wall surface is very deep or communicates with a wall cavity in a hollow wall structure. Patch material, such as plaster, introduced into such holes is typically not properly contained or supported.

Also, a problem arises when the hole is of an irregular shape. Such holes cannot be repaired using pre-sized or pre-shaped patches without first reshaping the hole to conform to a patch.

U.S. Pat. No. Design 324,170 discloses a combined doorstop and wall patch that merely covers a hole caused by a doorknob and provides a doorstop. U.S. Pat. No. 3,289,374 discloses a wall repair device requiring complicated assembly to accommodate irregular holes. U.S. Pat. No. 3,717,970 discloses a wallboard repair device for use in wallboard holes shaped to receive the repair device. U.S. Pat. No. 3,995,404 discloses an attachment for hollow walls which is installed by first cutting and removing wallboard surrounding a hole to conform to a geometrically-shaped repair panel. U.S. Pat. No. 4,152,877 discloses a wall repair clip for retaining a patch which has been cut to conform to the shape of the hole.

Prior art wall patching devices and methods fail to provide an uncomplicated system for supporting patching material within an irregularly-shaped wall hole to provide a repaired surface that is flush with the adjacent wall.

OBJECTS OF THE INVENTION

It is an object of this invention to provide a wall patching device and method that overcomes the problems associated with the prior art.

It is another object of this invention to provide a wall patching device and method for patching irregularly-shaped holes.

Another object of this invention is to provide a wall patching device and method for supporting wall patch material.

It is yet another object of this invention to provide a wall patching device and method that is easy to use.

SUMMARY OF THE INVENTION

This invention provides a wall patching device having one or more brackets having flanges for insertion into the edges of wall material forming a hole. The bracket, or a combination of brackets, forms a cage. A support is placed within the cage to support the patch material used to fill the hole.

This invention also provides a method for repairing a hole having an irregular shape. At least one bracket is provided and installed to form a cage within the hole or wall cavity. A support is placed within the cage to support patch material. Excess patch material is removed from the wall surface so that the repaired section is flush with the rest of the wall.

DETAILED DESCRIPTION OF THE INVENTION

Figure 1:
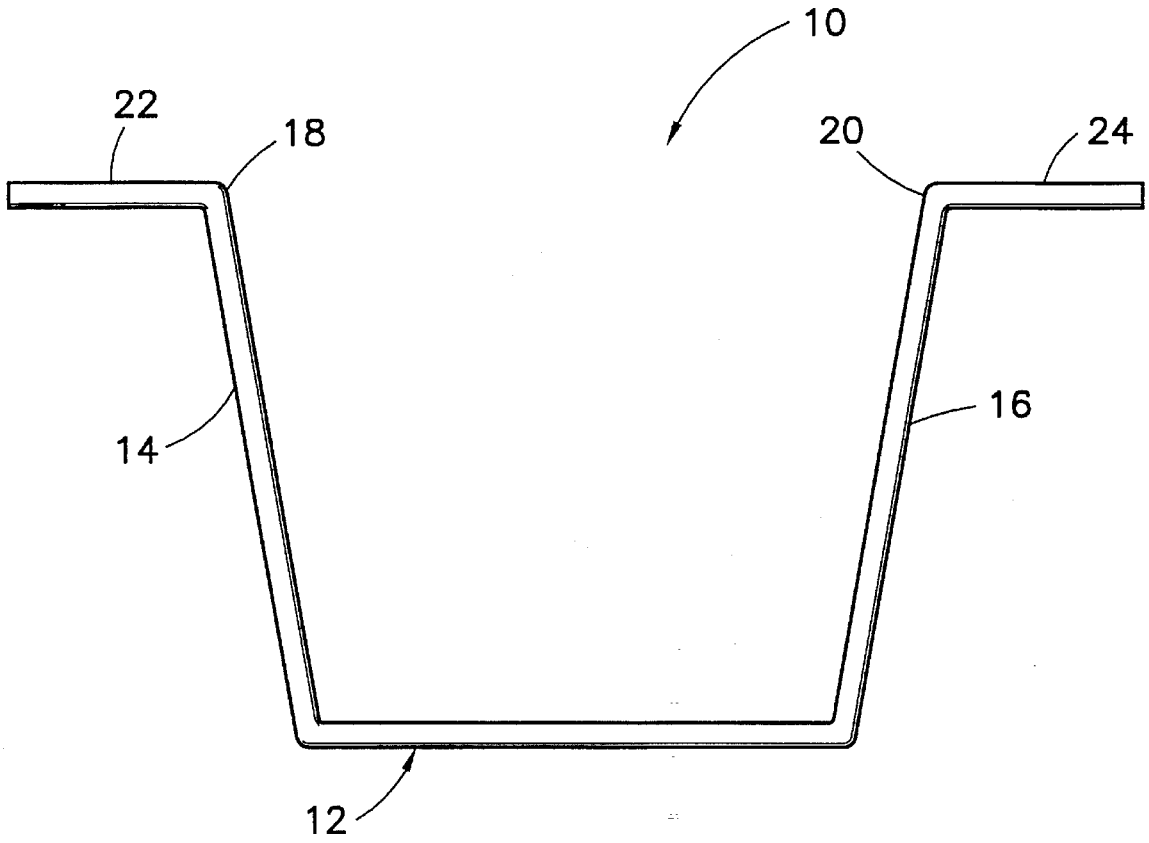
FIG. 1 is a side view illustrating an embodiment of a bracket component of the device according to this invention.

The following description is intended to refer to the specific embodiments of the invention illustrated in the drawings. This description is not intended to define or limit the scope of the invention, which is defined separately in the claims that follow.

Referring to FIG. 1, the numeral "10" designates generally a bracket component of the device according to this invention. Bracket 10 has a generally "U"-shaped body 12 with substantially parallel legs 14 and 16. Legs 14 and 16 terminate at end portions 18 and 20, respectively. Bracket 10 is provided with anchors or flanges 22 and 24 extending outwardly from end portions 18 and 20, respectively. Legs 14 and 16 and flanges 22 and 24 are optionally provided with a variety of dimensions, orientations and proportions, as will be described below. Also, flanges 22 and 24 optionally terminate at a point for reasons that will be made clear hereinafter. Body 12 of bracket 10 is optionally formed with a variety of dimensions and orientations so that the distance between legs 14 and 16 is larger or smaller than that shown and their respective angles relative to each other may be smaller or larger.

Bracket 10 is optionally formed using a variety of materials, including metallic wire or plastic rod, for example. Bracket 10 optionally has a rigid or flexible structure, depending on the intended application for the device, i.e., the material of the wall to be patched. However bracket 10 is preferably flexible so that it can be bent or deformed to accommodate a variety of hole sizes. Also, the cross-sectional shape of the material forming bracket 10 optionally has any shape and is optionally flat, round, or any other known shape.

Figure 1A:
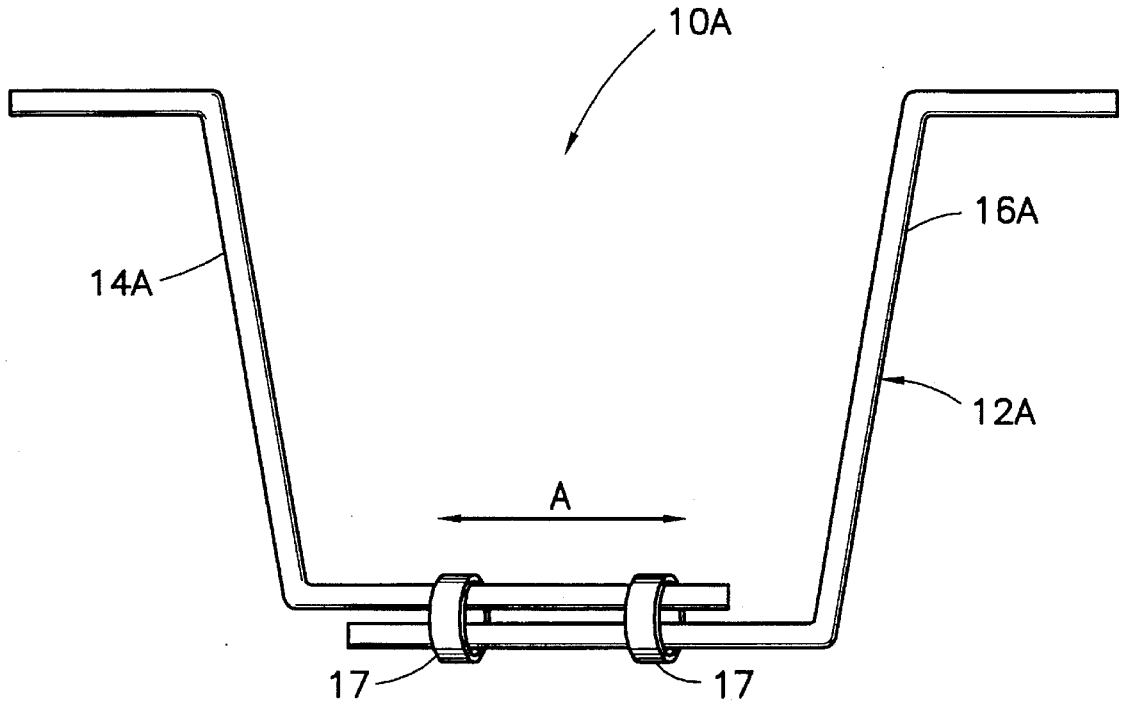
FIGS. 1A–1E illustrate examples of modifications to the bracket component shown in FIG. 1.

Referring to FIG. 1A, a bracket 10A is similar to bracket 10 (FIG. 1), except that bracket 10A has a width adjustable in direction "A". Bracket 10A has legs 14A and 16A on a two-part body 12A. At least one fastener, such as bands 17, holds legs 14A and 16A together while permitting sliding movement in direction "A". Accordingly, bracket 10A can be used with an increased range of hole sizes. It is contemplated that the shape of bracket 10A can be modified or adjusted and that bands 17 are optionally replaced with any known fastener or fasteners.

Figure 1B:
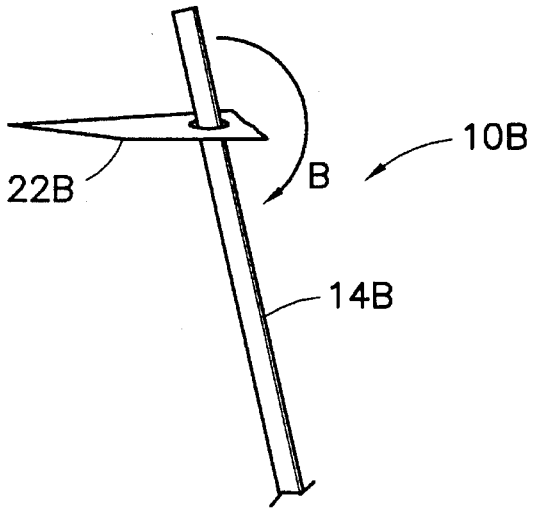

FIG. 1B illustrates a portion of a bracket 10B having a flange 22B with an adjustable position along a leg 14B. Flange 22B is optionally moved along leg 14B until leg 14B has a desired length. The end of leg 14B is then bent in direction "B" to capture flange 22B in the desired position. Accordingly, the position of flange 22B is adjusted to accommodate a variety of hole depths. Flange 22B is optionally provided with any desired shape and is shown to have a point for insertion into a wall surface.

Figure 1C:
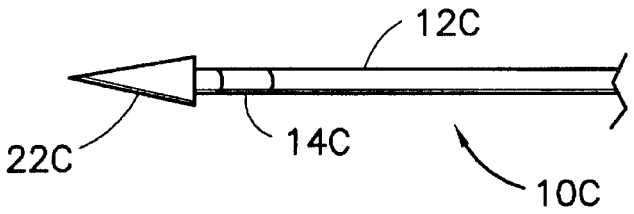

A portion of a bracket 10C is shown in FIG. 1C. Bracket 10C has a body 12C, a leg 14C, and a flange 22C. Flange 22C preferably has a flattened surface so that, when flange 22C is inserted in a wall surface, bracket 10C will be prevented from rotating with respect to the wall surface. Also, flange 22C preferably terminates in a point to assist in the insertion of flange 22C into the wall surface.

Figure 1D:
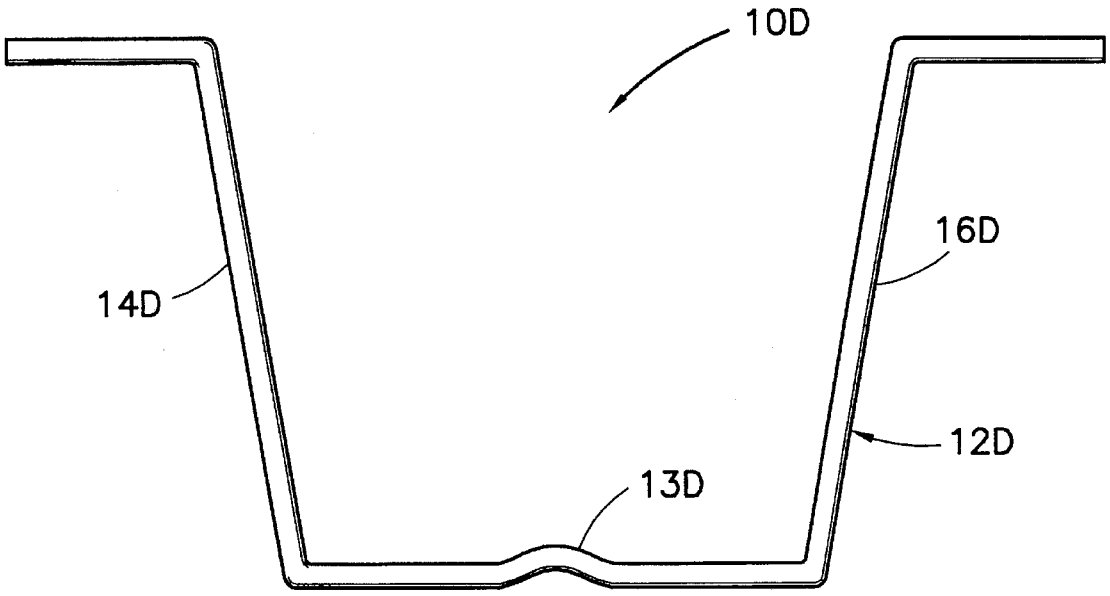
Figure 1E:
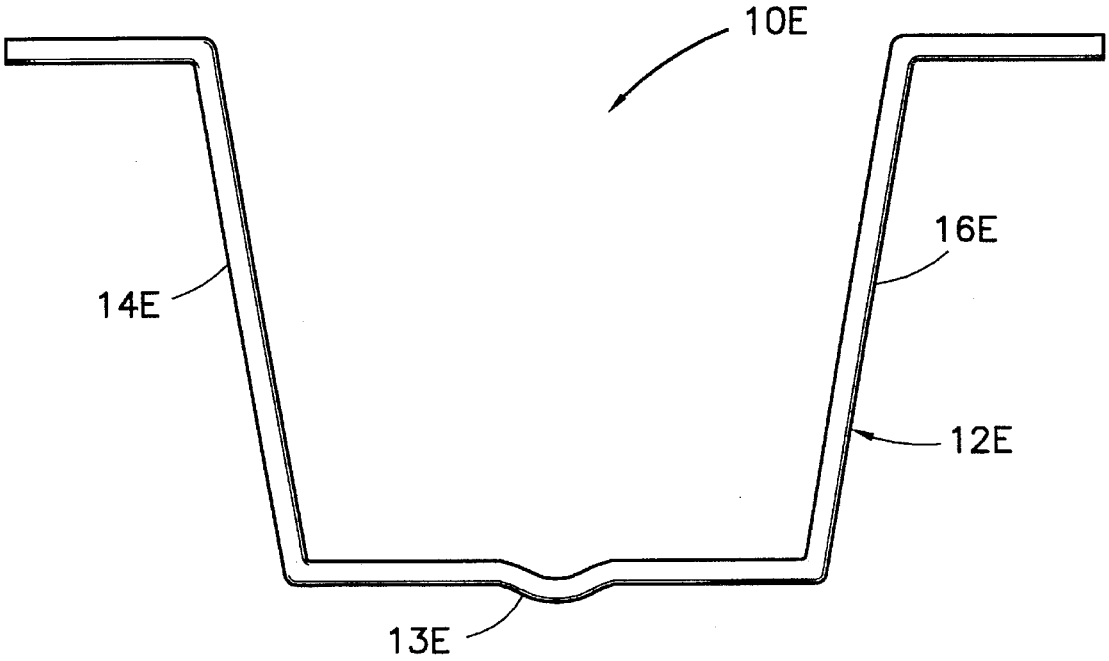

FIGS. 1D and 1E illustrate yet another possible modification to bracket 10. A bracket 10D (FIG. 1D), having a body 12D with legs 14D and 16D, is provided with a deflection 13D near the center of body 12D. Similarly, a bracket 10E shown in FIG. 1E, having body 12E with legs 14E and 16E, is provided with a deflection 13E near the center of body 12E. Deflections 13D and 13E provide optional clearance when brackets 10D and 10E are mounted either together or with bracket 10 (FIG. 1). For example, when brackets 10D and 10E are mounted at angles to one another in a wall hole, deflections 13D and 13E prevent interference between bodies 12D and 12E and permit the formation of an interlocked cage.

FIGS. 1A–1E illustrate several of many possible variations to bracket 10 shown in FIG. 1. Other modifications, with respect to shape, size, material and configuration, are of course contemplated.

Figure 2:
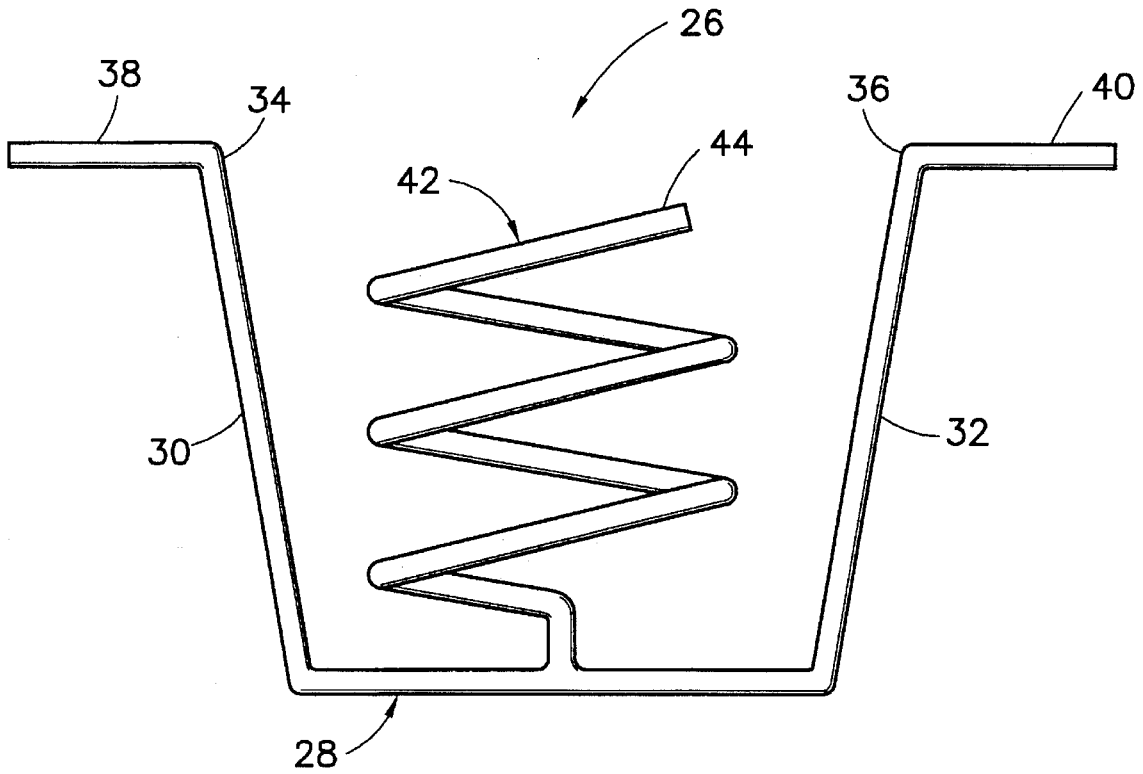
FIG. 2 is a side view illustrating another embodiment of a bracket component of the device according to this invention.

Referring to FIG. 2, the numeral "26" designates another embodiment of a bracket component of the device according to this invention. Bracket 26 has a body 28 with legs 30 and 32 terminating at end portions 34 and 36, respectively. Flanges 38 and 40 extend outwardly from end portions 34 and 36, respectively. Bracket 26 also includes a "corkscrew"-shaped retainer 42 which extends from body 28 and terminates at an end 44. Retainer 42 is optionally provided with one of many other shapes capable of performing its intended function, such as helices and the like. The purpose and function of retainer 42 will be described with reference to FIGS. 3, 5A and 5B.

Figure 2A:
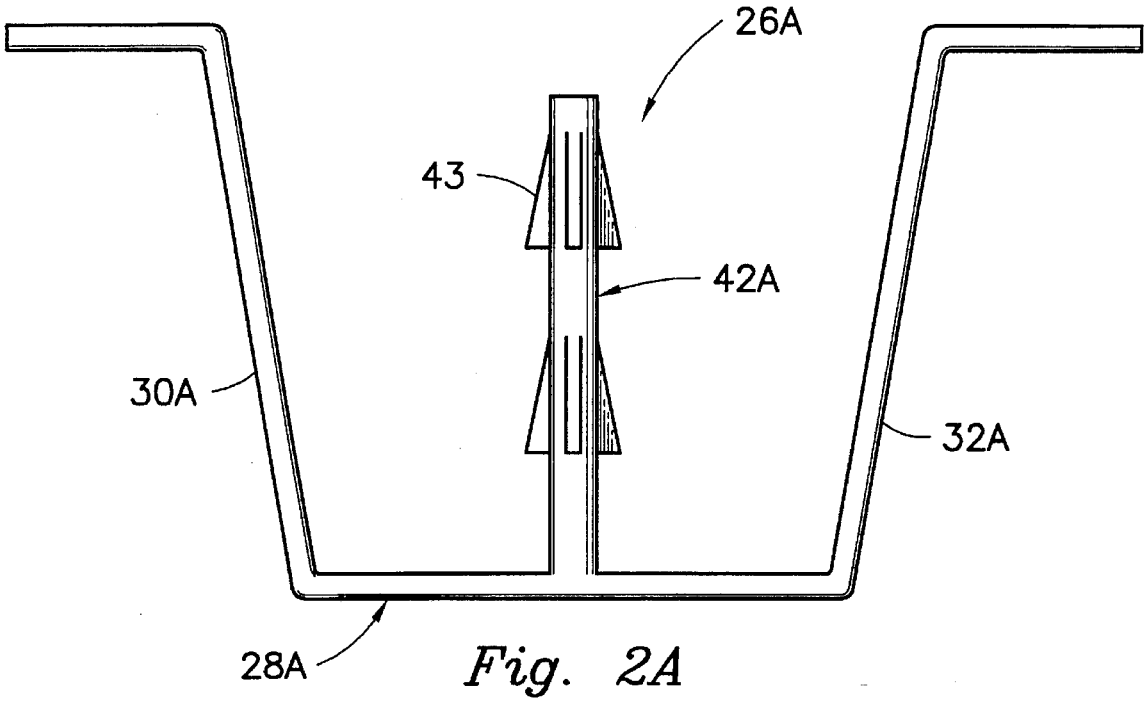
FIGS. 2A–2D illustrate examples of modifications to the bracket component shown in FIG. 2.

FIGS. 2A–2D illustrate several possible modifications to bracket 26 shown in FIG. 2. For example, FIG. 2A illustrates a bracket 26A having a body 28A with legs 30A and 32A. Bracket 26A also has a retaining post 42A having a plurality of spikes 43. Spikes 43 and retainer post 42A are provided to capture a material within bracket 26A as will be described with reference to FIGS. 3, 5A and 5B.

Figure 2B:
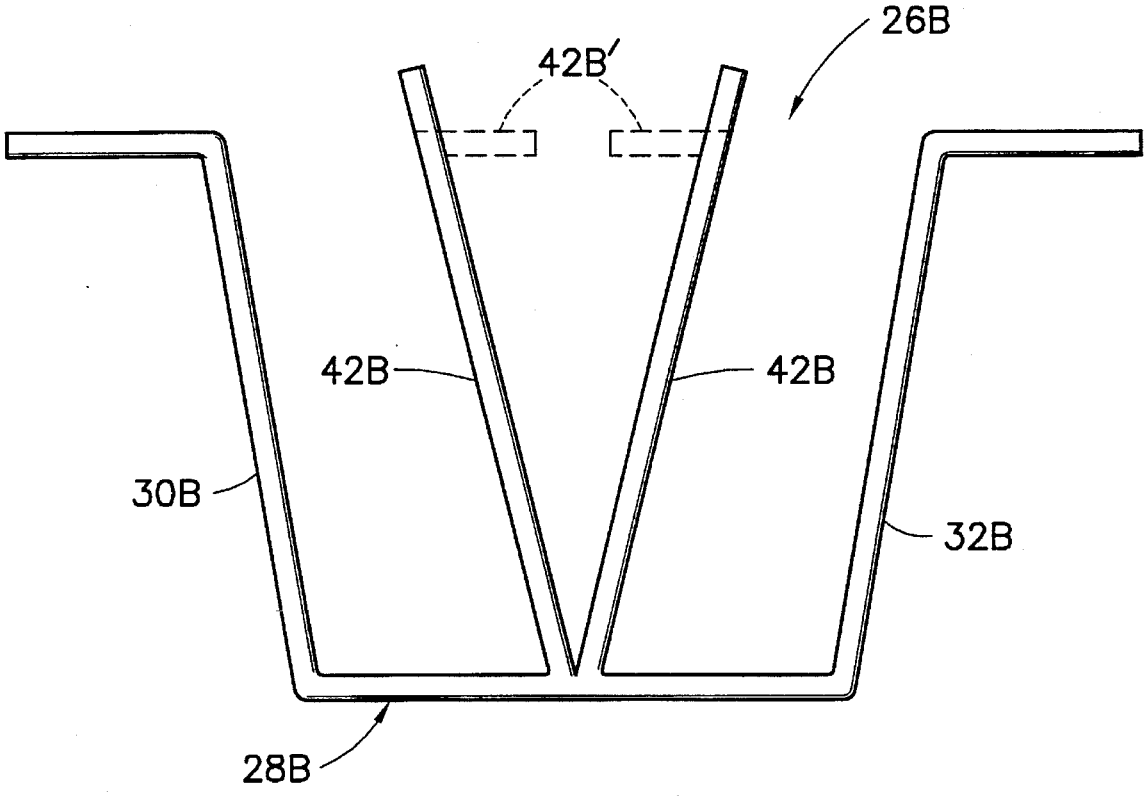

FIG. 2B illustrates a bracket 26B having a body 28B along with legs 30B and 32B. Bracket 26B includes bendable retainers 42B that are capable of being bent into a position such as those designated 42B' and shown in phantom lines. Retainers 42B are optionally used to retain a support material as will be described below.

Figure 2C:
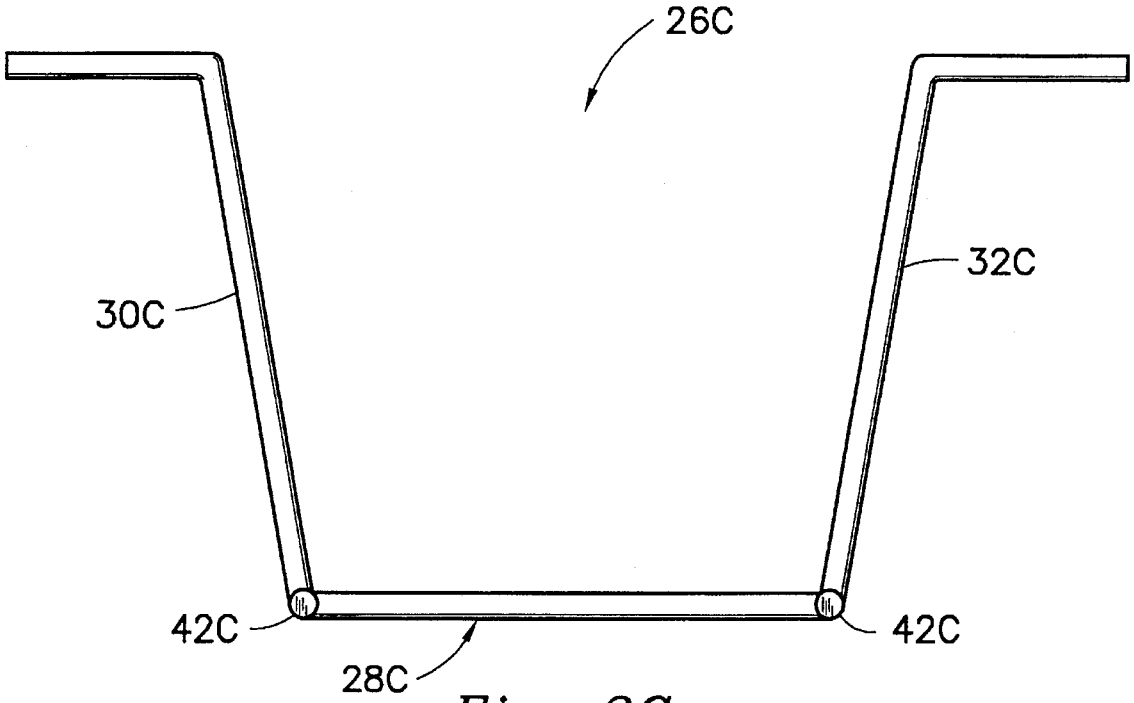
Figure 2D:
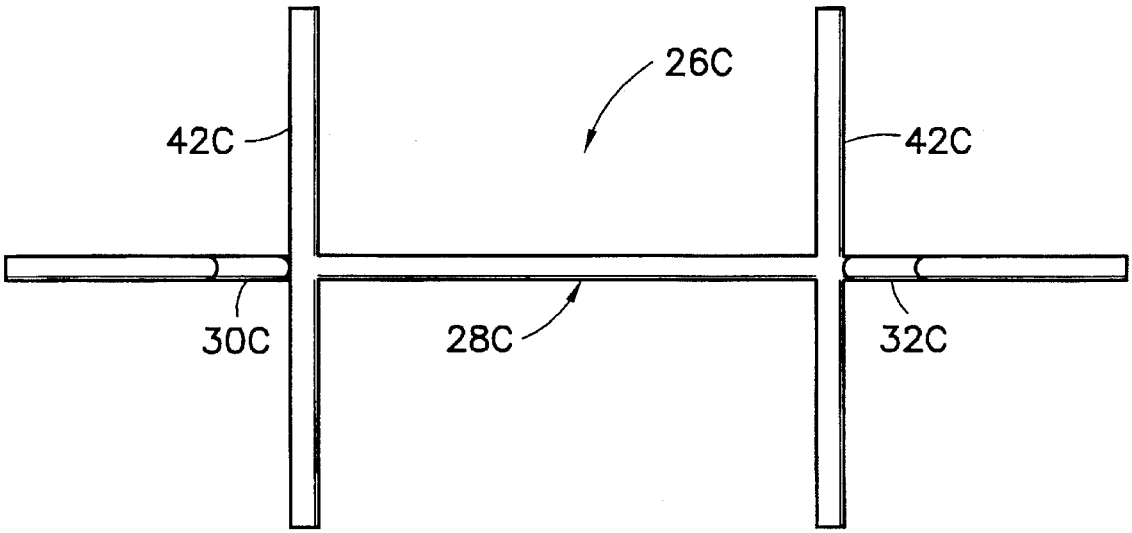

FIGS. 2C and 2D illustrate side and top views of a modified bracket 26C, respectively. Referring to FIGS. 2C and 2D, bracket 26C has a body 28C with legs 30C and 32C. Extending from each leg 30C and 32C are arms 42C. Although two arms 42C are shown, it is contemplated that one or any number of arms 42C are optionally provided. Arms 42C provide a base for a support material as will be described below with reference to FIGS. 3, 5A and 5B. Like retainers 42B shown in FIG. 2B, arms 42C are optionally movable or bendable to capture a component placed within bracket 26C.

FIGS. 2A–2D illustrate several of many possible variations to bracket 26 shown in FIG. 2. It is contemplated that many other variations, as well as modifications to the variations illustrated in the drawings, are optionally made.

Figure 3:
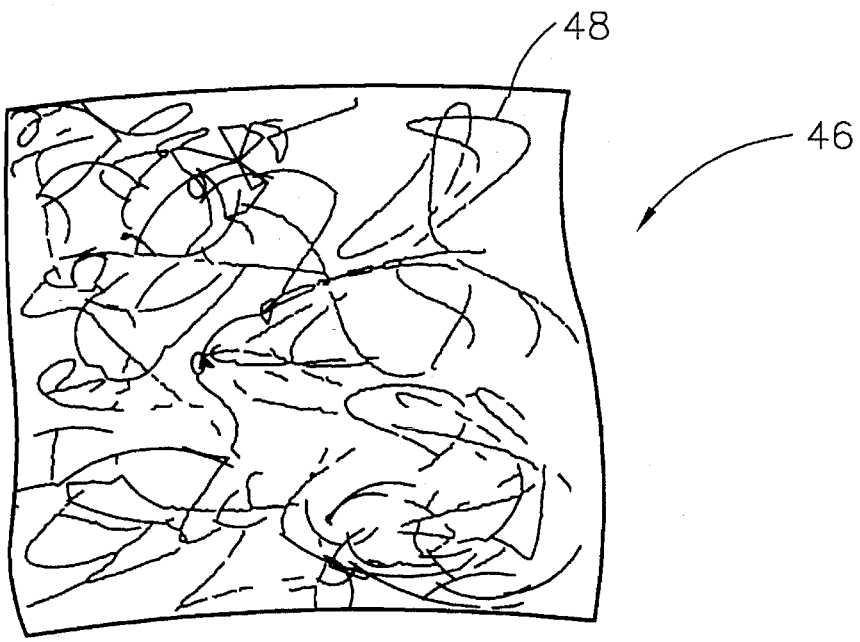
FIG. 3 is a side view illustrating an embodiment of a support component of the device according to this invention.

FIG. 3 shows an embodiment of a support component of the device according to this invention. A matrix or mesh support, generally designated "46," comprises a mesh material 48. Mesh material 48 is cut or formed into any shape and is preferably compressible. Mesh material 48 is optionally a metallic material such as "steel wool," a fibrous material, a plastic filament, a sponge-like material or any other known material.

Mesh support 46 is shaped to fit within a basket or cage formed by one or more brackets such as those shown in FIGS. 1, 1A–1E, 2 and 2A–2D. Mesh support 46 is optionally retained within the cage using retainer 42 of bracket 26 as shown in FIG. 2. Mesh support 46 is optionally "screwed" onto retainer 42 and compressed so that it is held within bracket 26. Mesh support 46 is optionally retained by spikes 43 on retaining post 42A in bracket 26A, retainers 42B in bracket 26B or arms 42C in bracket 26C.

Figure 4:
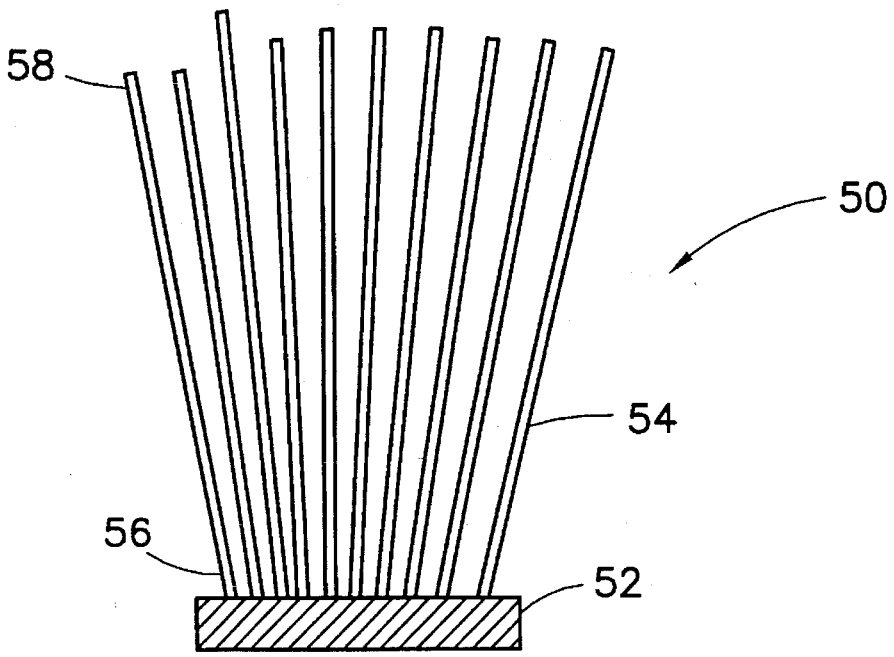
FIG. 4 is a side view illustrating another embodiment of a support component of the device according to this invention.

Referring to FIG. 4, the numeral "50" generally designates another support component of the device according to this invention. Support 50 is optionally placed within a cage formed by one or more brackets to support patch material. Support 50 has a base portion 52 to which "whiskers" or "bristles" 54 are attached. Bristles 54 are connected to base portion 52 at lower ends 56 and terminate at upper ends 58. Base 52 is connected to bristles 54 using any known method, including welds, injection molding, threaded fastening or any other known method, depending of course on the materials selected for base 52 and bristles 54.

Bristles 54 are optionally formed from a variety of materials, including plastic filaments, metallic wires or rods, or any other suitable material. Bristles 54 are optionally provided with a textured surface or a non-circular cross-section so that patch material will bond or adhere to the bristles. Whatever material, shape and surface is used for bristles 54, it is preferable that common wire cutters or even standard scissors can be used to cut and shorten the bristles.

Base 52 is optionally formed from any appropriate metallic, plastic or other material, which is optionally the same as, or different from, the material of bristles 54. Base 52 is preferably round, but is optionally provided with any suitable shape and thickness.

The device of this invention is preferably provided in the form of a kit. The kit preferably includes an assortment of bracket components having a variety of sizes and shapes. Referring to FIGS. 1 and 2, the kit preferably includes bracket components, such as brackets 10 and 26, having a variety of shapes, dimensions and materials so that the device of this invention can be used to patch holes having various depths, widths and lengths. Kits are optionally pre-assembled by a manufacturer. For example, a unit having two bracket members, a retainer and a support component is optionally preassembled prior to shipment.

Kits are also optionally provided for use with pre-selected hole diameter ranges. For example, kits are optionally provided for hole diameter ranges of 1" to 2", 2" to 3", etc.

The kit also preferably includes support components, such as supports 46 and 50 shown in FIGS. 3 and 4. The support components are optionally provided with a variety of preformed sizes or are adjustable in size by the user. For example, mesh support 46 is optionally provided in a variety of sizes or, alternatively, the user can cut, deform or compress mesh support 46 to conform to a variety of hole sizes. Similarly, support 50 is optionally provided with a variety of diameters or geometries for base 52 and a variety of lengths for bristles 54. Optionally, bristles 54 are cut by the user to conform to a specific hole depth and multiple supports 50 can be placed adjacent one another in a cage formed by one or more brackets to fill a large or irregularly-shaped hole.

The kit optionally includes one or more patching materials to be used with the device of this invention. Suitable patch materials include plaster, spackle, plastic wood, glazing compound or any other appropriate patching material, and are selected depending upon the specific application.

The method of this invention as well as the preferred use of the device of this invention will now be described with reference to FIGS. 5A, 5B, 6A and 6B.

Figure 5A:
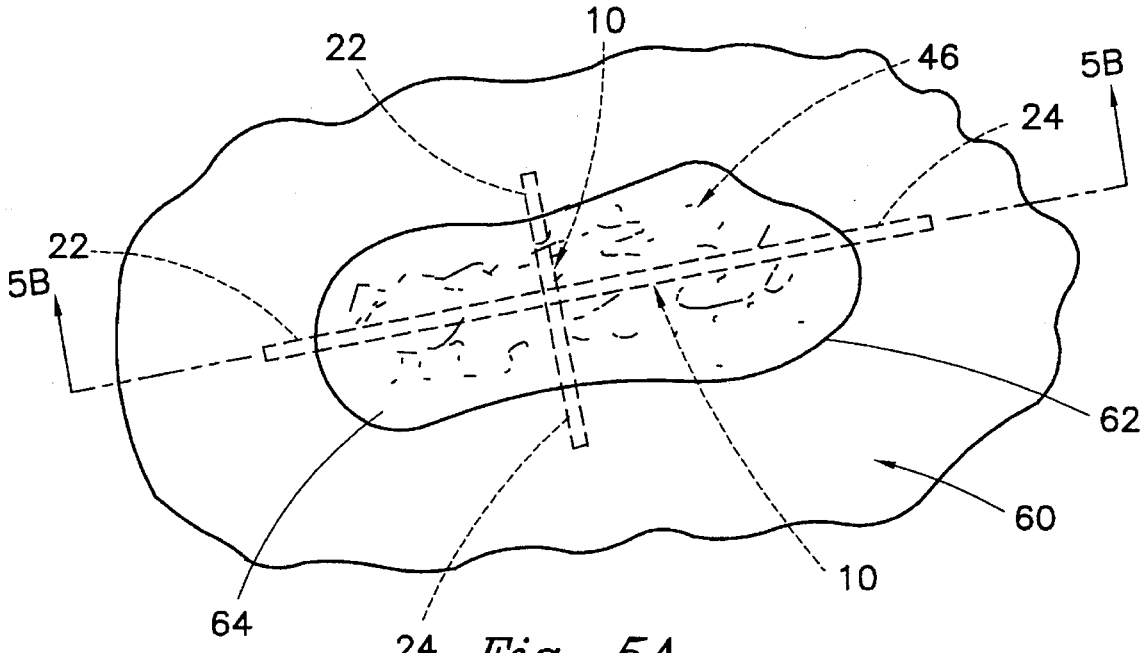
FIG. 5A is a view of a wall having a hole patched using a device and method according to this invention.

FIG. 5A illustrates a hole or recess 62 in a wall 60 that has been patched using the device shown in FIGS. 1 and 3. Hole 62, having an irregular shape that is elongated in one direction and relatively narrow in another direction, was repaired using two brackets 10, mesh material 46 and patch material 64.

Figure 5B:
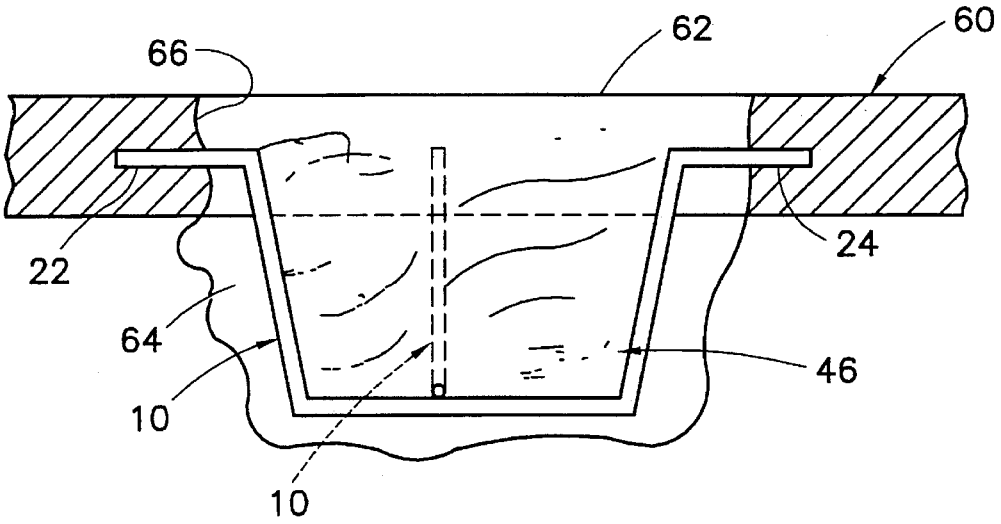
FIG. 5B is a cross-sectional view of the patched hole shown in FIG. 5A.

FIG. 5B is a cross-sectional view of the patched hole shown in FIG. 5A. FIG. 5B illustrates the relationship between brackets 10 where they cross one another. Flanges 22 and 24 of both brackets 10 are inserted into an edge 66 of hole 62 in wall 60. This is optionally accomplished by manually pressing flanges 22 and 24 into edge 66 or by using a tool such as the flat blade of a common screwdriver or a scissor-type tool having blades that expand away from one another to exert force against opposing flanges.

As shown in FIG. 5B, brackets 10 contain mesh support 46. Patch material 64 bonds to brackets 10, mesh support 46 and edge 66 to provide a patch that is integrally attached to wall 60. In fact, the patched surface may even be stronger than the original surface because of the brackets and the support encapsulated within or behind the patch material. This is particularly helpful for surfaces that are vulnerable to repeated damage, such as wall portions adjacent to doors which are contacted by doorknobs. Although some patch material 64 may extend beyond brackets 10 and mesh support 46, mesh support 46 limits the flow of patch material so that it does not tend to fill the wall cavity in the case of a hollow wall.

Referring to FIGS. 5A and 5B, the device of this invention is most preferably installed by (1) inserting a first bracket 10 into hole 62 in wall 60; (2) forcing flanges 22 and 24 of bracket 10 into opposing edges 66 of hole 62; (3) inserting a second bracket 10 into hole 62 in wall 60, positioned substantially perpendicular to the first bracket; (4) forcing flanges 22 and 24 of second bracket 10 into opposing edges 66 of hole 62, thereby forming a cage; (5) inserting into the cage a mesh support 46 and compressing the mesh so that it does not extend beyond the surface of wall 60; (6) applying patch material 64 to encompass brackets 10 and mesh support 46 and allowing the patch material to bond to the mesh support and brackets, and (7) finishing the surface of patch material 64 with a finishing layer and/or by sanding.

Although the device and method of this invention are adapted for use with irregularly shaped holes and recesses, hole 62 is optionally cut to accommodate the patch device, remove damaged surface portions, or for any other reason.

Figure 6A:
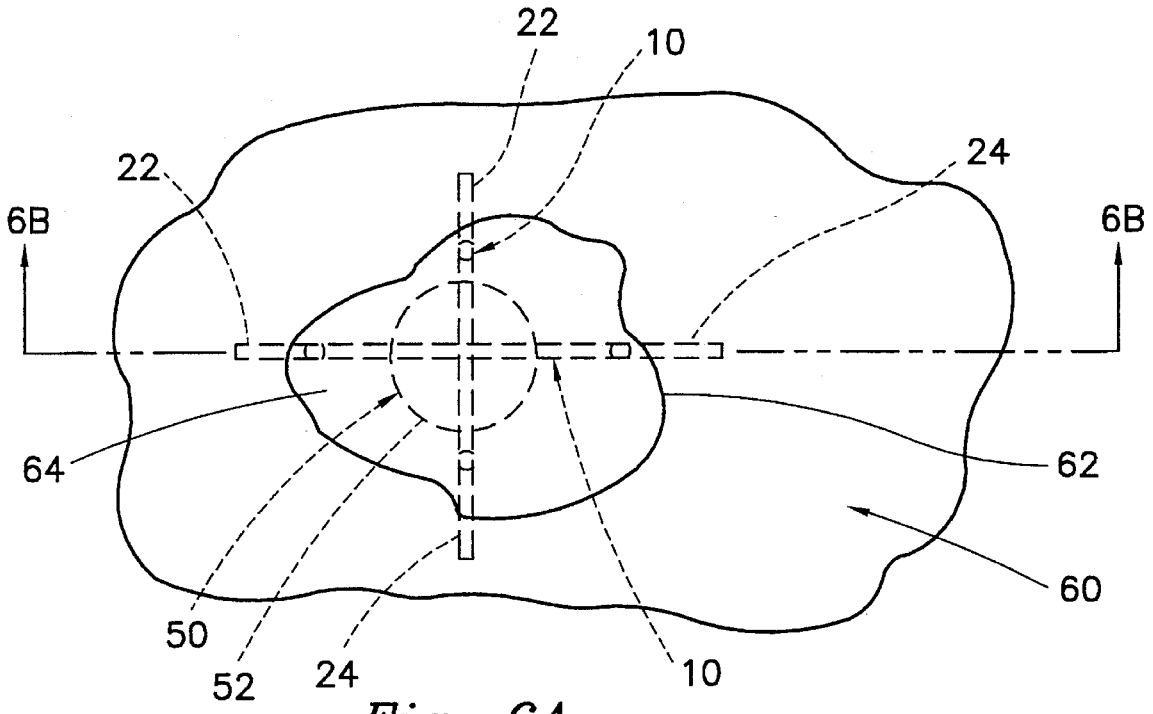
FIG. 6A is a view of a wall having a hole patched using another device and method according to this invention.
Figure 6B:
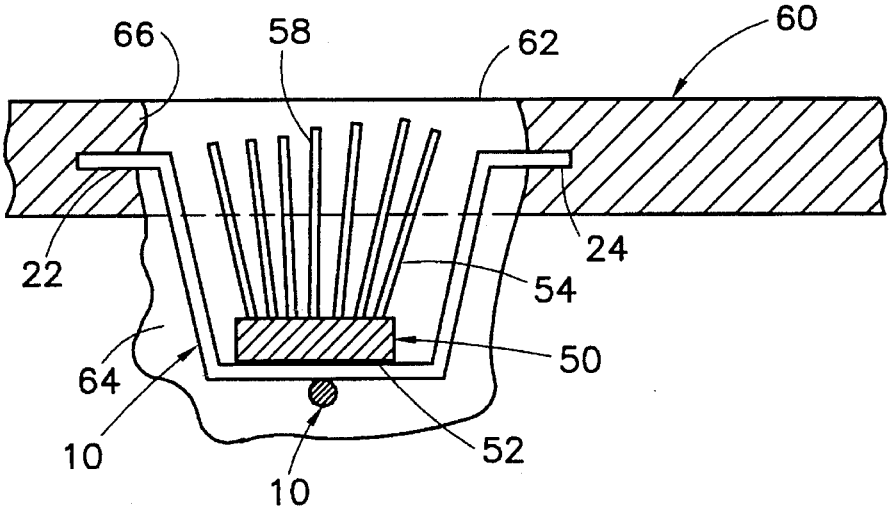
FIG. 6B is a cross-sectional view of the patched hole shown in FIG. 6A.

Referring to FIGS. 6A and 6B, a hole 62 in wall 60 is patched using a device and method similar to that described above, except that support 50 shown in FIG. 4 replaces mesh support 46. Support 50 is positioned within the cage formed by brackets 10 as shown in FIG. 6B. Support 50 is preferable attached to brackets 10 using an adhesive, patch material or a mechanical fastener such as a wire tie. Ends 58 of bristles 54 are cut or trimmed so that they do not extend beyond the surface of wall 60. Patch material 64 is then introduced so that it surrounds brackets 10 and support 50. Bristles 54 provide a support for patch material 64 and, when patch material 64 dries and bonds to support 50, bristles 54 act like "rebar" to support the patch material. Other aspects of the device and method illustrated in FIGS. 6A and 6B are the same as described above with reference to FIGS. 5A and 5B.

It is contemplated that many modifications can be made to the wall patching device illustrated in the figures, as well as the method described, without escaping the spirit and scope of this invention. For example, any number of brackets can be used to create a cage within a wall hole. One, two, three or more brackets are optionally used, depending upon the shape and size of the hole to be patched.

It is also contemplated that the shape of the brackets optionally varies significantly from that shown in the drawings. For example, brackets are optionally straight rods that are adapted to extend directly across a wall hole and are optionally formed from sheet material to provide a broader surface. Brackets are also optionally provided with pointed flanges to facilitate their insertion into the wall material. Also, it is contemplated that the brackets are formed from any metallic or plastic material.

Although the supports shown in the figures illustrate mesh-type and brush-type supports, it is contemplated that the supports can be formed from a variety of materials having a variety of shapes. Accordingly, supports can be formed from sponge-like material, foam, or any other material that can optionally be compressed, cut, shaped or formed into a desired shape. Alternatively, supports are optionally provided in predetermined sizes or shapes, not intended to be compressed, cut, shaped or formed.

The brackets are optionally provided with any form of retaining component, such as the retainer designated "42" in FIG. 2, to retain the support component in position. It is contemplated that such a retainer could be any mechanical fastener, adhesive or any known clamping device. It is also contemplated that the brackets do not include a retainer component.

Cross-members are optionally provided to retain bracket flanges in place in the wall surface. Suitable cross-members include any component capable of contacting upper ends of the bracket legs at or near the flanges and providing sufficient force to retain the position of the inserted flanges. Cross-members are optionally adjustable in length to accommodate various hole and bracket sizes. Alternatively, cross-members are cut to fit specific hole and bracket sizes during installation.

Although the device and method of this invention has been described with reference to wall holes or defects, it is contemplated that this invention can be used to patch holes, recesses or gaps in any material or item. For example, wood surfaces, metallic surfaces, and any other surfaces of any item are optionally patched using the device and method of this invention.

In any embodiment, this invention provides significant benefits. The device is adapted for patching holes having a regular or irregular shape and a variety of sizes and depths. The device is also adapted to provide a patch that is securely supported within the patched surface. The method of this invention permits patching of hollow surfaces and limits the amount of patch material that flows in a surface cavity.

What is claimed:

1. A wall patching device for repairing an opening in a surface, said opening defined by an edge surrounding said opening, said article comprising:

at least one bracket having a substantially "U"-shaped body with legs terminating at end portions and a flange connected to each said end portion, said flanges extending outwardly in substantially opposite directions, and said flanges being movable with respect to each other in said substantially opposite directions in an uninstalled condition and being inserted into said edge of said opening in an installed condition, said at least one bracket forming a cage when said flanges are in said installed condition; and a support positioned within an interior of said cage and being sized and shaped to substantially fill said interior of said cage and having at least one elongated element extending into said interior of said cage from a base of said bracket to which a patch material bonds.

2. The article described in claim 1, wherein said support comprises a base connecting a plurality of elongated elements to which said patch material bonds when said support is inserted into said cage and said patch material is introduced into said opening.

3. The article described in claim 1, wherein said support is a compressible body to which said patch material bonds when said support is inserted into said cage and said patch material is introduced into said opening.

* * * * *